US005560809A

United States Patent [19]

Cortellini

[11] Patent Number: 5,560,809

[45] Date of Patent: Oct. 1, 1996

[54] IMPROVED LINING FOR ALUMINUM PRODUCTION FURNACE

[75] Inventor: Edmund A. Cortellini, North Brookfield, Mass.

[73] Assignee: Saint-Gobain/Norton Industrial Ceramics Corporation, Worcester, Mass.

[21] Appl. No.: 451,872

[22] Filed: May 26, 1995

[51] Int. Cl.[6] ..... C25C 3/08

[52] U.S. Cl. ..... 204/243 R

[58] Field of Search ..... 204/67, 243 R, 204/247

[56] References Cited

U.S. PATENT DOCUMENTS

| | | | |
|---|---|---|---|
| 2,915,442 | 12/1959 | Lewis | 204/243 R |
| 2,971,899 | 2/1961 | Hanink et al. | 204/243 R |
| 3,428,545 | 2/1969 | Johnson | 204/243 R |
| 4,592,820 | 6/1986 | McGeer | 204/243 R |
| 4,865,701 | 9/1989 | Beck et al. | 204/241 X |

*Primary Examiner*—Donald R. Valentine
*Attorney, Agent, or Firm*—Thomas M. DiMauro

[57] ABSTRACT

There is provided a sidewall lining for use in an electrolytic reduction cell for the production of aluminum by reduction of alumina in a molten fluroide electrolyte, the lining consisting essentially of a ceramic material having a density of at least 95% of theoretical density and at least closed porosity, the ceramic material selected from the group consisting of silicon carbide, silicon nitride and boron carbide.

16 Claims, 1 Drawing Sheet

IMPROVED LINING FOR ALUMINUM PRODUCTION FURNACE

BACKGROUND OF THE INVENTION

Conventional virgin aluminum production typically involves the reduction of alumina which has been dissolved in a cryolite-containing electrolyte. The reduction is carried out in a Hall-Heroult cell ("Hall cell") containing a carbon anode and a carbon cathode which also serves as a container for the electrolyte. When current is run through the electrolyte, liquid aluminum is deposited at the cathode while gaseous oxygen is produced at the anode.

The sidewalls of the Hall cell are typically made of a porous, heat conductive material based on carbon or silicon carbide. However, since it is well known in the art that the cryolite-containing electrolyte aggressively attacks these sidewalls, the sidewalls are designed to be only about 3–6 inches thick so as to provide enough heat loss out of the Hall cell to allow the formation of a frozen layer of cryolite on the surface of the sidewall, thereby preventing further cryolite infiltration and degradation of the sidewall.

Although the frozen cryolite layer successfully protects the sidewalls from cryolite penetration, it does so at the cost of significant heat loss. Accordingly, modern efficiency concerns have driven newer Hall cell designs to contain more heat insulation in the sidewalls. However, since these designs having significant thermal insulation also prevent significant heat loss, cryolite will not freeze against its sidewalls. Therefore, the initial concerns about cryolite penetration and sidewall degradation have reappeared.

U.S. Pat. No. 4,592,820 ('the '820 patent") attempts to provide both thermal efficiency and sidewall protection from cryolite penetration. The '820 patent teaches replacing the porous, heat conductive sidewall with a two-layer sidewall comprising:

a) a first layer made of a conventional insulating material provided in sufficient thickness to assure that cryolite will not freeze on the sidewall, and b) a lining made of a ceramic material resistant to attack by the cell electrolyte (cryolite) and molten aluminum.

See column 2, lines 30–43 of the '820 patent. The '820 patent further discloses that preferred linings are made of Group IVb, Vb or VIb refractory metal carbides, borides or nitrides, oxynitrides and especially titanium diboride and teaches these selected ceramic materials can be used as either fabricated tiles or as coatings on sidewalls such as alumina or silicon carbide. See column 2, lines 44–47 and column 4, lines 24–32.

Although the '820 patent provides a cryolite-resistent aluminum reduction cell having improved heat efficiency, it nonetheless can be improved upon. For example, the disclosed linings suffer from high cost and limited availability. Moreover, the preferred lining of the '820 patent, titanium diboride, is not only very expensive, it also possesses marginal oxidation resistance and is electrically conductive in operation.

In addition, the preferred Hall cell of the '820 patent produces a solid cryolite layer in the electrolyte zone adjacent the top edge of the sidewall to protect the ceramic material against aerial oxidation. This top layer may be developed by either capping the sidewall with carbon and reducing its backing insulation, or by positioning a steel pipe carrying cool air adjacent the top edge of the sidewall. Although these measures improve cryolite resistance, they also reduce the heat efficiency of the cell.

Accordingly, there is a need for an improved Hall Cell.

SUMMARY OF THE INVENTION

In accordance with the present invention, there is provided a sidewall lining for use in an electrolytic reduction cell for the production of aluminum by reduction of alumina in a molten fluroide electrolyte, the lining consisting essentially of a ceramic material having a density of at least 95% of theoretical density and at least closed porosity, the ceramic material selected from the group consisting of silicon carbide, silicon nitride and boron carbide.

In preferred embodiments, the ceramic material is used in the form of a tile or panel, more preferably at least 0.5 cm thick.

DETAILED DESCRIPTION OF THE INVENTION

Figure 1:
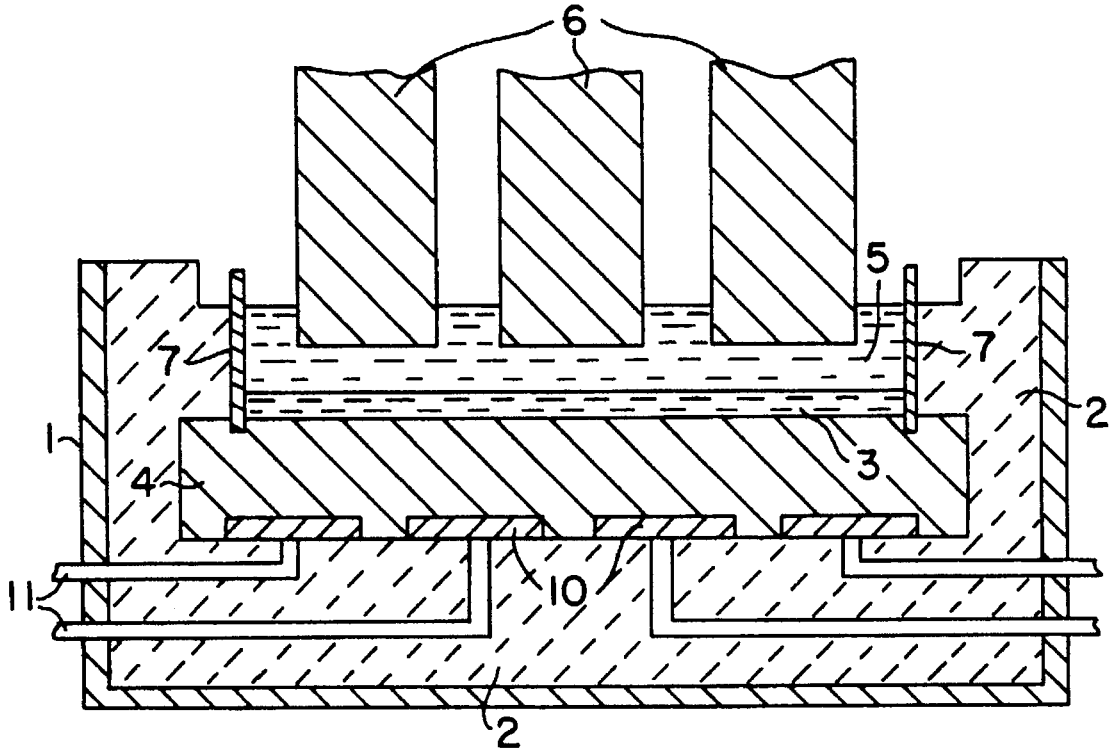
FIG. 1 is a drawing of a preferred embodiment of the present invention.

Use of silicon carbide as the sidewall lining offers an advantage over the materials disclosed in the '820 patent in that it has better thermal shock resistance than and is less expensive than titanium diboride, and is more stable than oxynitrides when in contact with cryolite. Interestingly, the '820 patent twice discourages using silicon carbide as the sidewall lining. First, it asserts the unsuitable performance of the SiC-containing lining disclosed in U.S. Pat. No. 3,256,173. See column 3, lines 40–43 of the '820 patent. Second, it advocates placing a boride, nitride or oxynitride coating thereon when SiC is used as the sidewall. See column 2, line 47 of the '820 patent.

If silicon carbide is selected as the sidewall lining, it should be at least 95% dense and should have an apparent porosity of near zero. If needed, conventional sintering aids such as boron, carbon and aluminum may be be present in the silicon carbide ceramic material. Accordingly, any hot pressed, hot isostatically pressed or pressureless sintered silicon carbide ceramic having either at least closed porosity and preferably no apparent porosity is contemplated as within the scope of the invention.

Use of boron carbide as the sidewall lining offers an advantage over the materials disclosed in the '820 patent in that it is an electrical insulator, has a lower thermal conductivity than, and is less expensive than titanium diboride.

If boron carbide is selected as the sidewall lining, it should be at least 95% dense and should have an apparent porosity of near zero. If needed, conventional sintering aids such as boron, carbon and aluminum may be present in the boron carbide ceramic material. Accordingly, any hot pressed, hot isostatically pressed or pressureless sintered boron carbide ceramic having at least closed porosity and preferably no apparent porosity is contemplated as within the scope of the invention.

Use of silicon nitride as the sidewall lining offers an advantage over the materials disclosed in the '820 patent in that it is an electrical insulator, has a lower thermal conductivity than, and is less expensive than titanium diboride.

If silicon nitride is selected as the sidewall lining, it should be at least 95% dense and should have an apparent porosity of near zero. If needed, conventional sintering aids such as magnesia, yttria, and alumina be be present in the silicon nitride ceramic material. Accordingly, any hot pressed, hot isostatically pressed or pressureless sintered silicon nitride ceramic having at least closed porosity and preferably no apparent porosity is contemplated as within the scope of the invention.

The teachings of the '820 patent respecting damping movement of the molten metal pool(column 4, lines 57–66); fixing the ceramic material on the sidewall (column 4, lines 20–44); using a current collection system which ensures that the current passes substantially vertically through the carbon bed (column column 2, line 58 to column 3, line 25); and, using panels at least 0.25 cm or 0.5 cm thick as the lining (column 4, line 67 to column 5, line 3) may also be suitably used in accordance with the present invention and are hereby incorporated by reference herein.

Although not particularly preferred, the teaching of the '820 patent advocating a frozen cryolite layer at the top of the sidewall may also be practiced in accordance with the present invention. However, preferred embodiments of the present invention are designed with a consistent vertical heat loss profile so that no upper frozen cryolite layer is formed.

Referring now to FIG. 1, there is provided a sectional side view of an electrolytic reduction cell of the present invention. Within a steel shell 1 is a thermally and electrically insulating sidewall 2 of alumina blocks. The cathode of the cell is constituted by a pad 3 of molten aluminum supported on a bed 4 of carbon blocks. Overlying the molten metal pad 3 is a layer 5 of molten electrolyte in which anodes 6 are suspended. Ceramic tiles 7 constitute the sidewall lining. These are fixed at their lower edges in slots machined in the carbon blocks 4, their upper edges being free. Because no cooling means is introduced at the top of the sidewalls, no solid crust has been formed at the top edge of the electrolyte layer.

A current collector bar 10 is shown in four sections between the carbon bed 4 and the alumina sidewall 2. Each section is connected at a point intermediate its ends to a connector bar 11 which extends through the shell 1. The electrical power supply between the anodes 6 and the connector bars 11 outside the shell 1 is not shown.

In use, electrolyte 5 is maintained at a temperature of about 960° C. The thermal insulation behind the ceramic tiles 7 is so good that a layer of frozen electrolyte does not form anywhere on the tiles. The current collection system 10 and 11 ensures that the current passes substantially vertically through the carbon bed 4.

I claim:

1. A sidewall lining for use in an electrolytic reduction Hall cell for the production of aluminum by reduction of alumina in a molten fluoride electrolyte containing cryolite, the cell comprising a sidewall, the sidewall having a top edge and comprising an insulating material and the lining wherein:

a) the insulating material is provided in sufficient thickness to assure that cryolite will not freeze anywhere but the top edge of the sidewall, and b) the lining consists essentially of a ceramic material having a density of at least 95% of theoretical density and at least closed porosity, the ceramic material selected from the group consisting of silicon carbide, silicon nitride and boron carbide, wherein the top edge of the sidewall has a frozen electrolyte crust thereon.

2. The lining of claim 1 consisting essentially of silicon carbide having essentially no apparent porosity.

3. The lining of claim 2 in the form of a tile or panel.

4. The lining of claim 3 wherein the tile or panel is at least 0.5 cm thick.

5. The lining of claim 1 consisting essentially of boron carbide having essentially no apparent porosity.

6. The lining of claim 5 in the form of a tile or panel.

7. The lining of claim 6 wherein the tile or panel is at least 0.5 cm thick.

8. The lining of claim 1 consisting essentially of silicon nitride having essentially no apparent porosity.

9. The lining of claim 8 in the form of a tile or panel.

10. The lining of claim 9 wherein the tile or panel is at least 0.5 cm thick.

11. An electrolytic reduction Hall cell for the production of aluminum by reduction of alumina in a molten fluoride electrolyte maintained at a temperature of about 960 C. and containing cryolite, the cell comprising:

i) means for maintaining the molten fluoride electrolyte at a temperature of about 960 C., and ii) a sidewall comprising an insulating material and a lining, wherein:

a) the insulating material is provided in sufficient thickness to assure that cryolite will not freeze anywhere on the lining, and b) the lining is made of a ceramic material resistant to attack by cryolite and molten aluminum.

12. The cell of claim 11 wherein the lining consists essentially of a ceramic material having a density of at least 95% of theoretical density and at least closed porosity, the ceramic material selected from the group consisting of silicon carbide, silicon nitride and boron carbide.

13. The cell of claim 12 wherein the lining has no apparent porosity.

14. The cell of claim 13 wherein the lining consists essentially of silicon carbide.

15. An electrolytic reduction Hall cell for the production of aluminum by reduction of alumina in a molten fluoride electrolyte containing cryolite, the cell comprising a sidewall comprising an insulating material and a lining, wherein:

a) the insulating material is provided in sufficient thickness to assure that cryolite will not freeze anywhere on the lining, and b) the lining is made of a ceramic material resistant to attack by cryolite and molten aluminum, wherein the lining consists essentially of silicon nitride having a density of at least 95% of theoretical density, at least closed porosity and no apparent porosity.

16. An electrolytic reduction Hall cell for the production of aluminum by reduction of alumina in a molten fluoride electrolyte containing cryolite, the cell comprising a sidewall comprising an insulating material and a lining, wherein:

a) the insulating material is provided in sufficient thickness to assure that cryolite will not freeze anywhere on the lining, and b) the lining is made of a ceramic material resistant to attack by cryolite and molten aluminum, wherein the lining consists essentially of boron carbide having a density of at least 95% of theoretical density, at least closed porosity and no apparent porosity.

* * * * *